US007140797B2

(12) United States Patent
Hunter et al.

(10) Patent No.: US 7,140,797 B2
(45) Date of Patent: Nov. 28, 2006

(54) MULTI-CARTRIDGE DISPENSER

(75) Inventors: John Hunter, Moon Township, PA (US); Albert E. Sandholm, Brooklyn, CT (US)

(73) Assignee: Plas-Pak Industries, Inc., Norwich, CT (US)

( * ) Notice: Subject to any disclaimer, the term of this patent is extended or adjusted under 35 U.S.C. 154(b) by 55 days.

(21) Appl. No.: 11/062,161

(22) Filed: Feb. 18, 2005

(65) Prior Publication Data

US 2006/0188314 A1 Aug. 24, 2006

(51) Int. Cl.
*B43K 5/02* (2006.01)

(52) U.S. Cl. ..... 401/188 R; 401/187; 401/204; 222/137; 222/145.6

(58) Field of Classification Search ..... 401/48, 401/120, 123, 187, 188 R, 190, 204, 208, 401/219; 222/132, 135–137, 145.6, 326, 222/327, 389, 400.5, 402
See application file for complete search history.

(56) References Cited

U.S. PATENT DOCUMENTS

| | | | | |
|---|---|---|---|---|
| 3,570,719 | A | 3/1971 | Schiff | |
| 3,949,746 | A | 4/1976 | Wallach | |
| 4,067,479 | A | 1/1978 | Moline | |
| 4,273,261 | A | 6/1981 | Krueger | |
| 4,369,898 | A | 1/1983 | Andersson | |
| 4,437,498 | A | 3/1984 | Pankratz et al. | |
| 4,588,318 | A * | 5/1986 | O'Brien et al. | 401/146 |
| 4,676,410 | A * | 6/1987 | von Flue | 222/327 |
| 4,690,306 | A | 9/1987 | Staheli | |
| 4,823,992 | A | 4/1989 | Fiorentini | |
| 4,865,226 | A | 9/1989 | Becker et al. | |
| 4,934,827 | A | 6/1990 | Taschke et al. | |
| 4,986,443 | A | 1/1991 | Saur et al. | |
| 5,020,693 | A * | 6/1991 | Ernst et al. | 222/137 |
| 5,033,518 | A | 7/1991 | Ruhl | |
| 5,217,146 | A | 6/1993 | Neff et al. | |
| 5,246,143 | A | 9/1993 | Cherfane | |
| 5,286,105 | A | 2/1994 | Herold et al. | |
| 5,314,092 | A | 5/1994 | Jacobsen et al. | |
| 5,358,145 | A | 10/1994 | Smith et al. | |
| 5,405,054 | A | 4/1995 | Thomas | |
| 5,795,390 | A | 8/1998 | Cavallaro | |
| 6,371,336 | B1 | 4/2002 | Keller | |
| 6,457,609 | B1 | 10/2002 | Keller | |
| 6,514,569 | B1 | 2/2003 | Crouch | |
| 6,631,829 | B1 | 10/2003 | Wagner et al. | |
| 6,793,428 | B1 * | 9/2004 | Lithgow | 401/48 |

* cited by examiner

*Primary Examiner*—Huyen Le

(57) ABSTRACT

A multi-cartridge powered dispenser includes a frame having base and top cartridge supports, wheels and a handle. A piston/cylinder is mounted on the frame and at least three cartridges are clamped between the support plates. Each cartridge has a shuttle at the lower end and a discharge opening at the upper end. The piston/cylinder assembly has push rods extending through the base support to move the shuttles in the cartridges. A pressurized fluid supply conduit is connected to the piston/cylinder, and a valve in the fluid supply conduit controls the flow. Discharge cannulae communicate with the outlets the cartridges. Discharge conduits extend between the cannulae and a handpiece for applying the contents of the cartridges to a work surface. The application handpiece can be a sprayer, a roller applicator, or a pour/extrude applicator.

23 Claims, 11 Drawing Sheets

MULTI-CARTRIDGE DISPENSER

BACKGROUND OF THE INVENTION

The present invention relates to cartridge dispensers and, more particularly, to powered dispensers for multiple cartridges.

Various types of compositions are incorporated into cartridges which are then placed in dispensers which may be manual or power operated. Some dispensers are used to dispense the contents of two cartridges containing reactants. Exemplary of such reactant systems are two part epoxy coating materials, and foam sealants, and insulating materials. Because the reactants are not always admixed in a 1:1 ratio, different size cartridges may be employed or complicated mechanisms may dispense the reactants at different rates.

The existing multi-cartridge or plural component powered devices tend to be expensive and those with variable rates for dispensing the cartridges are relatively complicated to make operate and maintain.

It is an object of the present invention to provide a novel multi-cartridge powered dispenser which is capable of operating with different size cartridges and to enable different ratios of components in the output stream.

It is also an object to provide such a dispenser which is relatively rugged in structure, relatively simple to operate, and easy to maintain.

A further object is to provide such a dispenser which can be coupled with various applicator devices.

Yet another object is to provide such a device which can be adapted to admix reactants of different flow characteristics.

SUMMARY OF THE INVENTION

It has now been found the foregoing and related objects may be readily attained in a multi-cartridge powered dispenser having a frame including base and top cartridge supports and coupling elements extending therebetween. Wheels are provided on the base of the frame for movement of the dispenser, and a handle is included for moving the dispenser. A piston/cylinder is supported on the frame and clamped between the base and a bottom support, and seated on the bottom support are at least three product containing cartridges each having a shuttle at the lower end and a discharge opening at the upper end. The cartridges are clamped between the lower support and an upper support. The piston/cylinder has at least three push rods extending through the bottom support to move the shuttles in the cartridges.

A first pressurized fluid supply conduit with a valve therein is connected to the piston/cylinder. A discharge cannula communicates with the outlets of one or more of the cartridges, and a discharge conduit extends between the cannula and a handpiece for applying the contents of the cartridges to a work surface. A control on the handpiece opens and closes the valve in the fluid supply conduit to control the supply of fluid to the piston/cylinder and thereby the discharge of the contents of the cartridges and the flow of the contents to the handpiece.

The dispenser desirably includes releasable engagement means on the top support to clamp the cartridges when engaged and, upon release of the engagement means, to permit the top support to be moved to an unblocking position permitting insertion and removal of cartridges.

The cartridges may be of equal diameter and volume, or the cartridges may vary in diameter and volume.

In a preferred embodiment, two pairs of cartridges are provided, and a cannula is connected to each pair, and a pair of discharge conduits extending from the two cannulae to the handpiece. Preferably, a bleed valve is provided between each discharge cannula and each discharge conduit to bleed air from the cartridges.

A static mixer is coupled to the handpiece and the contents of the cartridges are admixed in the static mixer. The handpiece may be a sprayer or a roller or a pour or extrude applicator. Desirably, a gas supply conduit for gas under pressure is connected to the handpiece to spray the contents being supplied thereto, and a second valve controls the flow of gas therethrough.

Desirably, the upper support is pivotably mounted on the frame for movement to and from an unblocking position. The conduits from the cannulae to the handpiece may be of different diameter to accommodate different flow characteristics of the product passing therethrough.

At least one of the cartridge supports has multiple cartridge positioning formations for seating one end of the cartridges. Desirably, at least one of the cartridge supports provides multiple pairs of cartridge positioning formations to receive and position cartridges of different diameters. The piston includes multiple cooperating elements for positioning of pairs of push rods in coaxial alignment with cartridges of different diameters.

In one arrangement, second and third cannulae are provided in communication with individual cartridges and second and third discharge conduits are provided between the second and third cannulae and the handpiece.

The cartridges may include a collapsible bag in which the contents are disposed and a cylindrical sleeve in which the bag and shuttle are disposed, and the sleeve and shuttle may be revised.

In some instances, a conduit from a source of dispersible additives may be connected to the handpiece to disperse an additive in the output of the handpiece.

BRIEF DESCRIPTION OF THE DRAWINGS

FIGS. 7*a*–7*c* are similar views of another combination of unequal pairs;

DETAILED DESCRIPTION OF THE PREFERRED EMBODIMENT

Figure 1:
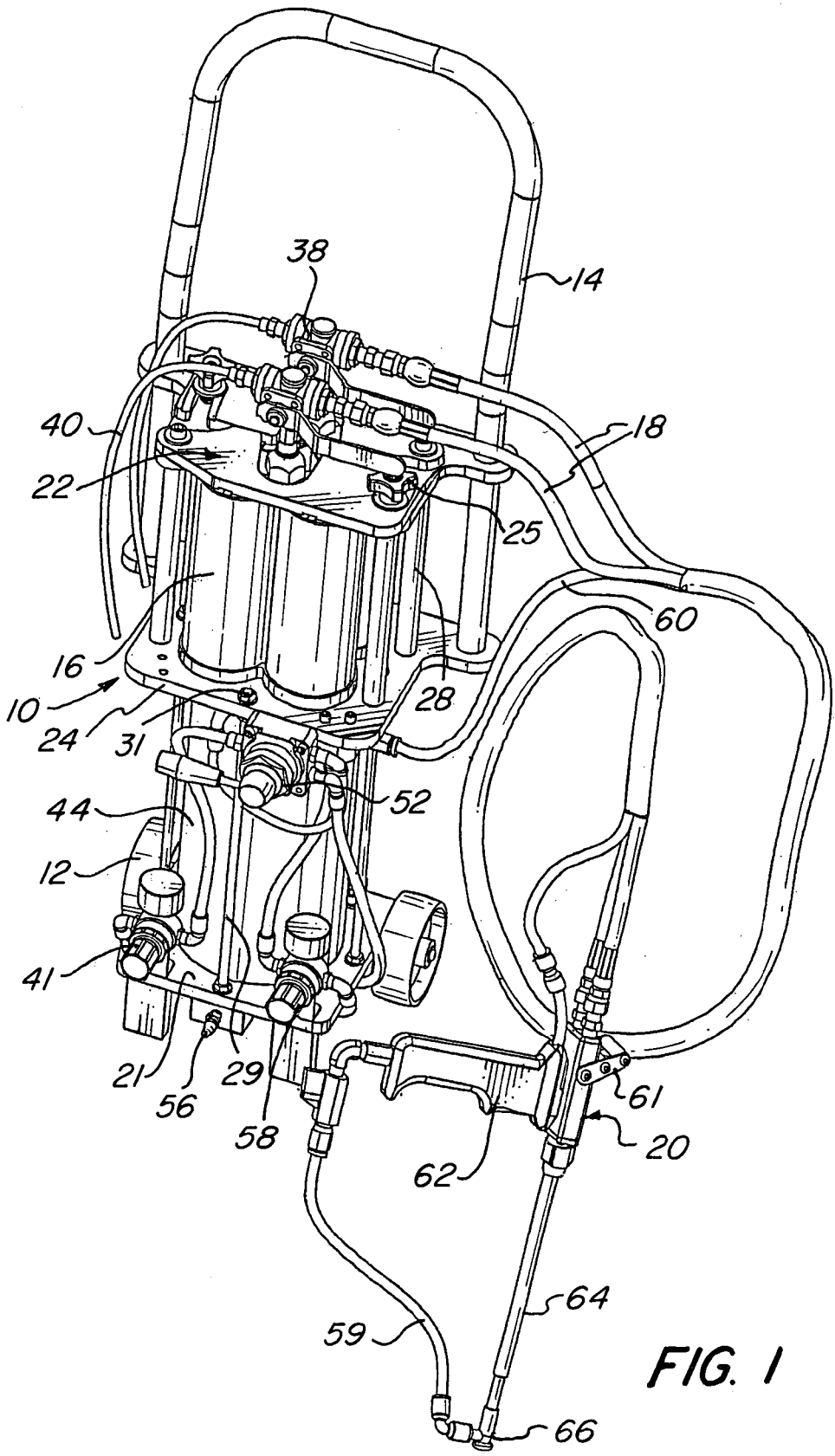
FIG. 1 is a front perspective view of a multi-cartridge powered dispenser embodying the present invention.
Figure 2:
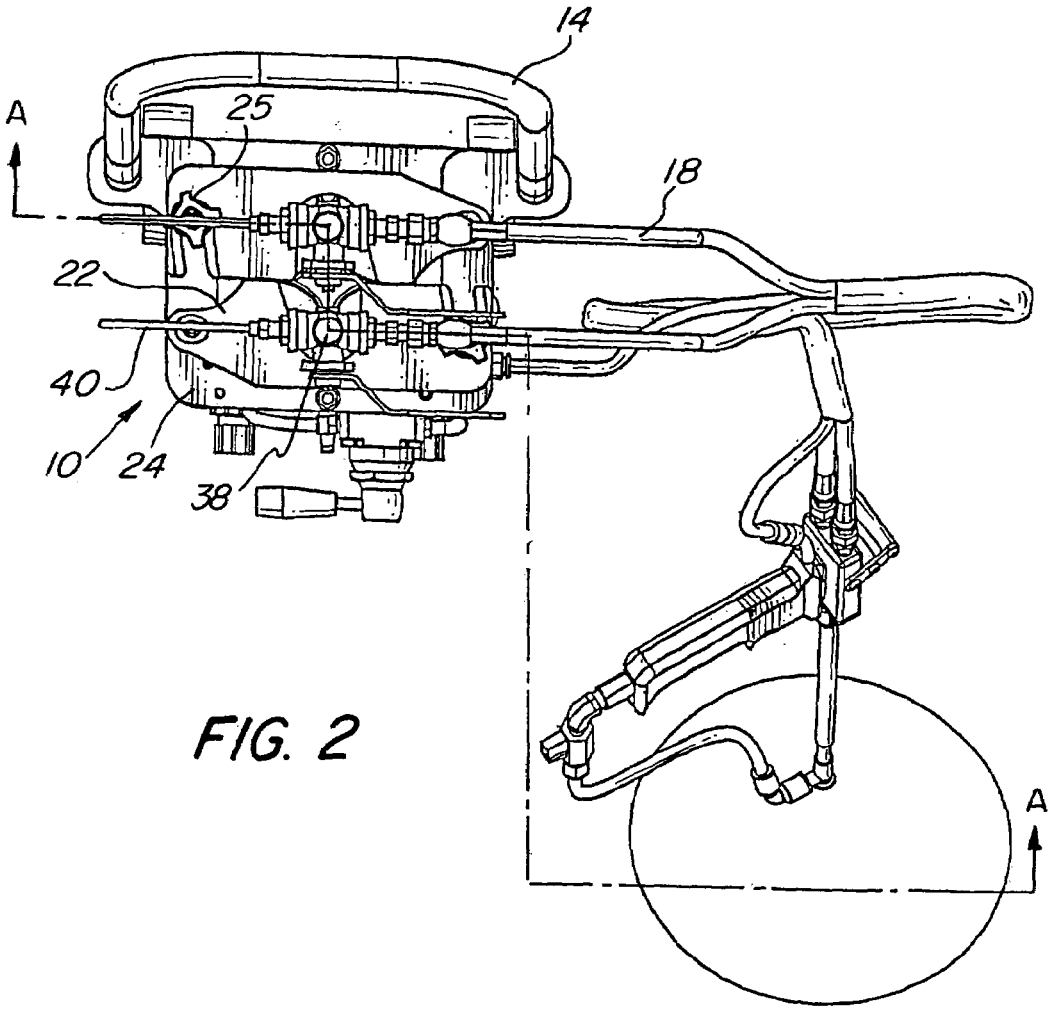
FIG. 2 is a top view thereof.
Figure 3:
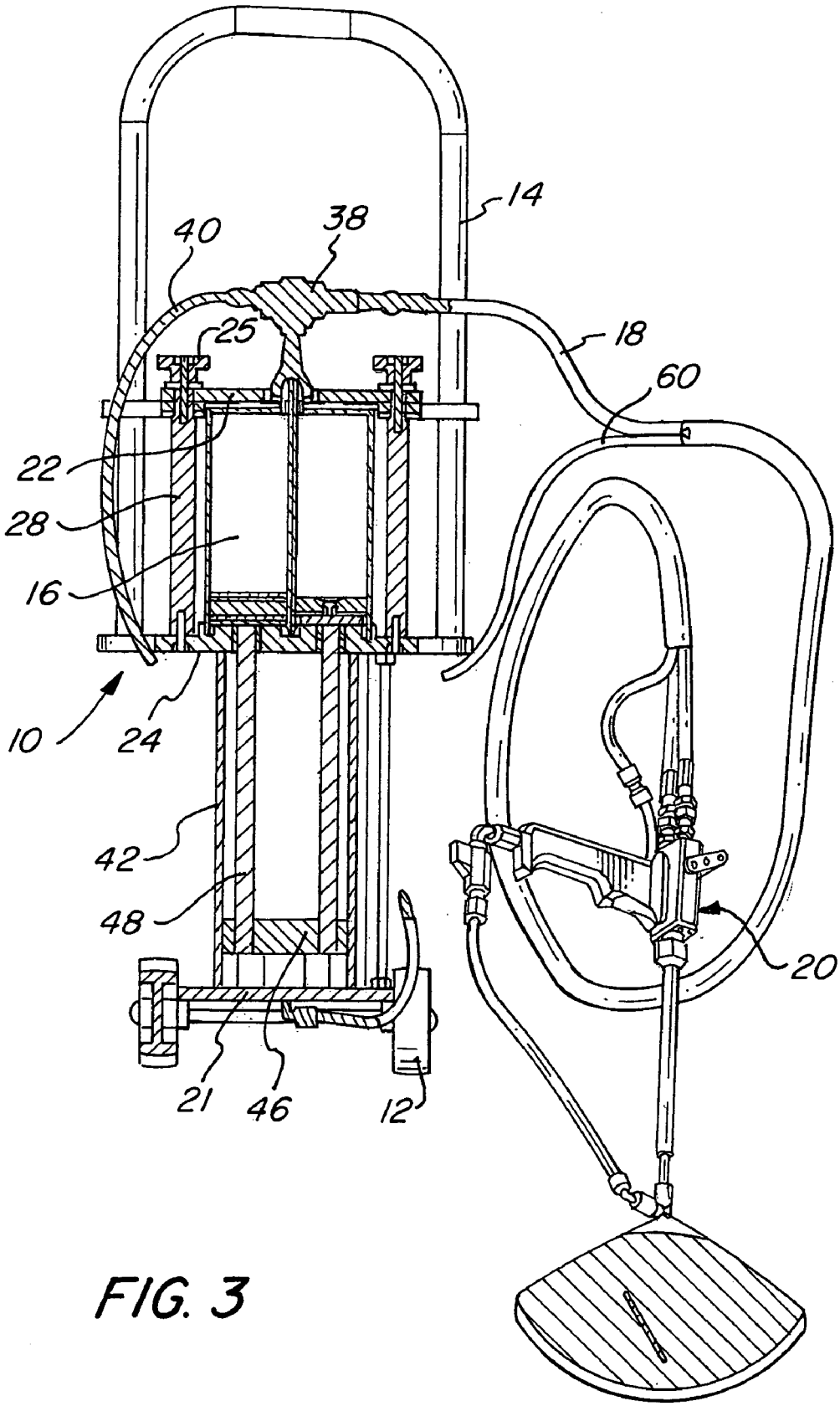
FIG. 3 is a sectional view thereof along the line A—A of FIG. 2.

Turning first to FIGS. 1 and 3 of the attached drawings, therein illustrated is a multi-cartridge powered dispenser embodying the present invention. A frame generally designated by the numeral 10 has wheels 12 on its base and a handle 14 to facilitate its movement. The contents of cartridges 16 mounted therein are conveyed by discharge hoses 18 to the sprayer handpiece generally designated by the numeral 20.

Figure 9:
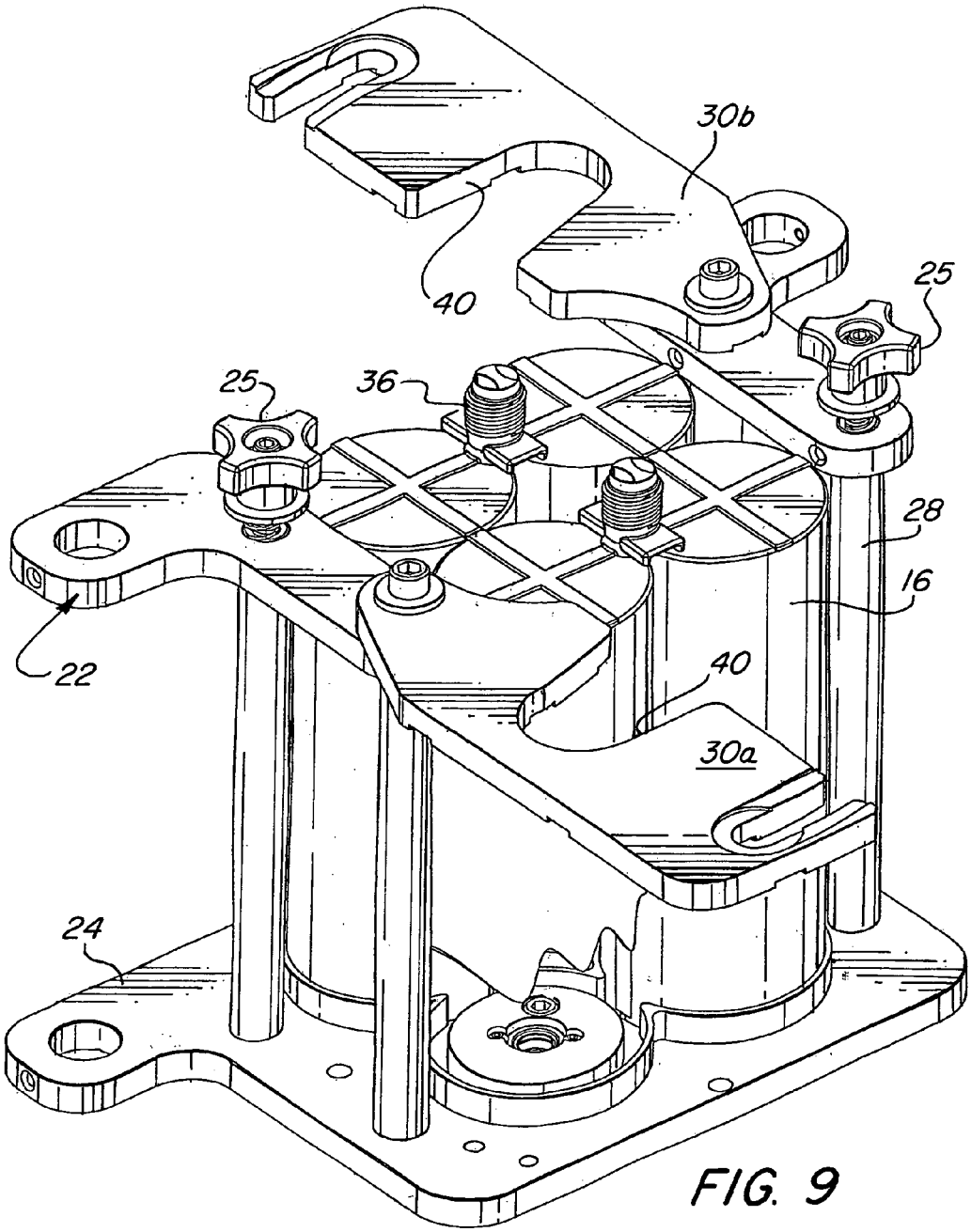
FIG. 9 is a perspective view of the dispenser with the two parts of the segmented top support pivoted into a cartridge unlocking position to permit replacement of the cartridges.
Figure 10A:
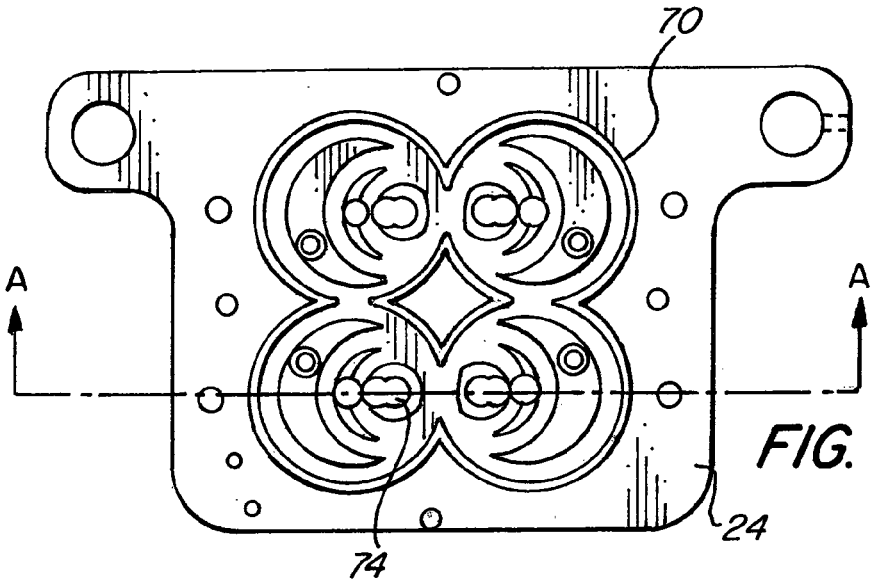
FIG. 10*a* is a plan view of the bottom cartridge support.
Figure 10B:
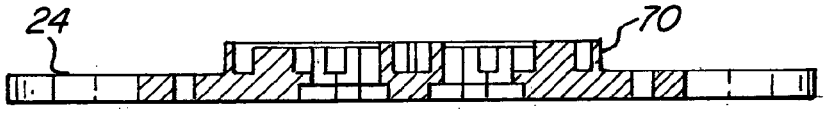
FIG. 10*b* is a sectional view along the line A—A of FIG. 10*a*.
Figure 10C:
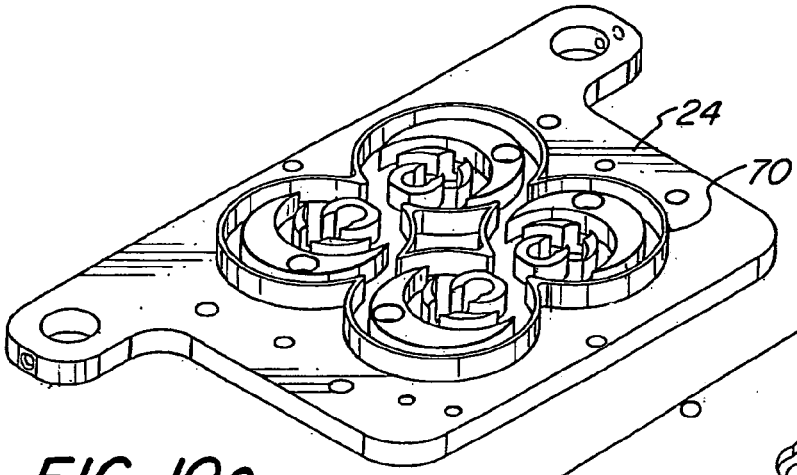
FIG. 10*c* is a perspective view of the top surface thereof.
Figure 10D:
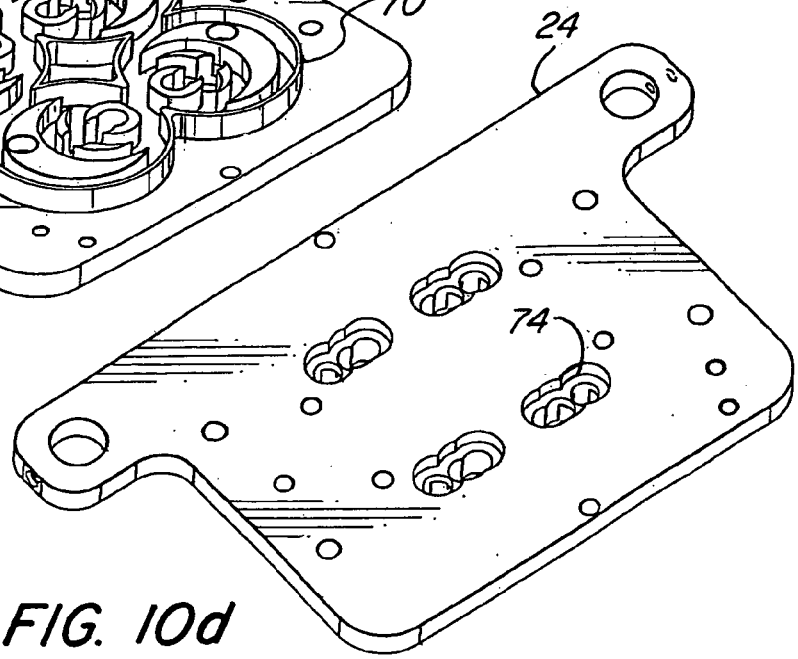
FIG. 10*d* is a perspective view of the bottom surface thereof.

Mounted on the frame 10 are a base plate 21 and top and bottom support plates 22, 24 between which the cartridges 16 are clamped by the knobs 25 which are threadably engaged on the coupling rods 28. Coupling rods 29 extend between the base plate 21 and the bottom support plate 22, and nuts 31 are tightened to securely clamp the cylinder 44. As seen in FIG. 9, the upper support plate 22 is formed of two segments 30*a*, 30*b* which are pivotably supported on the coupling rods 32. The segments 30*a*, 30*b* have notches 40 in which the cannulae 36 may be received in the latched position. In the pivoted position seen in FIG. 9, the cartridges 16 can be readily replaced.

The cartridges 16 have discharge openings (not shown) in their upper ends which communicate with a cannulae 36 on which are mounted bleeder valves 38 for venting air from the cartridges 16 as the dispenser begins operation. The discharge hoses 18 are connected to the valves 38 and a vent hose 40 is also connected thereto.

Figure 4A:
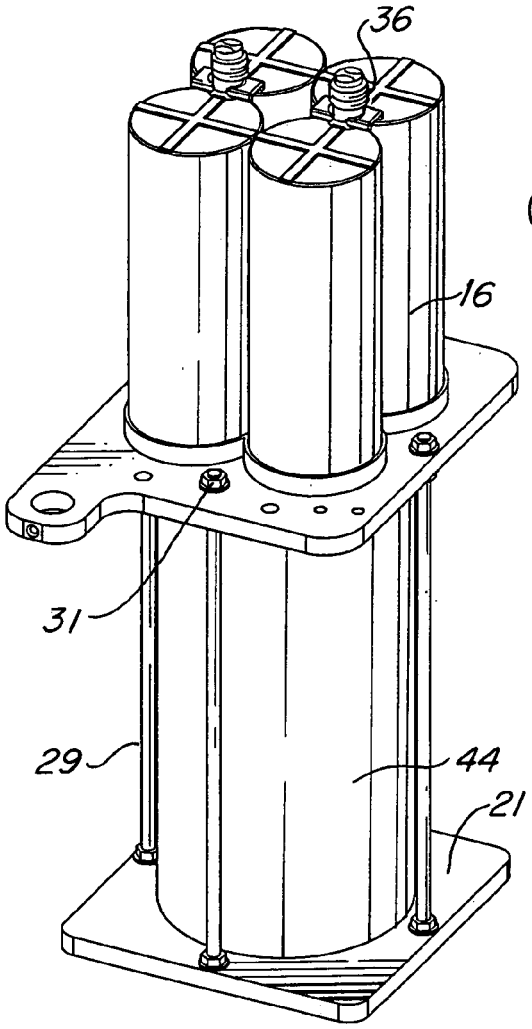
FIG. 4*a* is a perspective view of the piston/cylinder and four cartridges of equal volume supported on the bottom support.

As best seen in FIGS. 3 and 4*a*, a piston/cylinder unit generally designated by the numeral 42 is mounted on the base plate 21 of the frame 10, and it includes the cylinder 44 with a piston 46 which supports push rods 48 which extend upwardly through the end plug 45 and bottom support plate 24 to bear upon the shuttles 50 in the cartridges 16.

When air or other fluid under pressure is introduced into the bottom of the cylinder 44 through the air supply regulator 41, the piston 46 is moved upwardly causing the push rods 48 to bear upon the shuttles 50 moving them upwardly in the cartridges 16. This forces the contents out of the discharge openings into the cannulae 36, and thence through the valves 38 into the discharge hoses 18.

The supply of pressurized air or other fluid to the cylinder 44 is controlled by the directional valve 52 which is operable to change the direction of movement of the piston 46, thereby returning the piston 46 to the start position seen in FIG. 3.

A supply of pressurized air or other fluid for operation of the dispenser is coupled to the inlet fitting 56 from which air flows to the piston valve 52 and to a sprayer supply valve/regulator 58 to which a sprayer air conduit 60 is connected.

Turning to the hand piece or sprayer 20, it has a hand grip 62 and may have a trigger (not shown). Coupled to the handpiece 20 are the discharge hoses 18 and an air delivery conduit 60. The contents of the cartridges 16 are discharged into the static mixer 64 and then the mixture is sprayed through the nozzle 66. Pressurized gas is supplied to a plenum in the nozzle 66 through the air delivery conduit 59. On the handpiece 20 is a spool valve 61 which is used to control the air supply regulator 41.

Figure 4B:
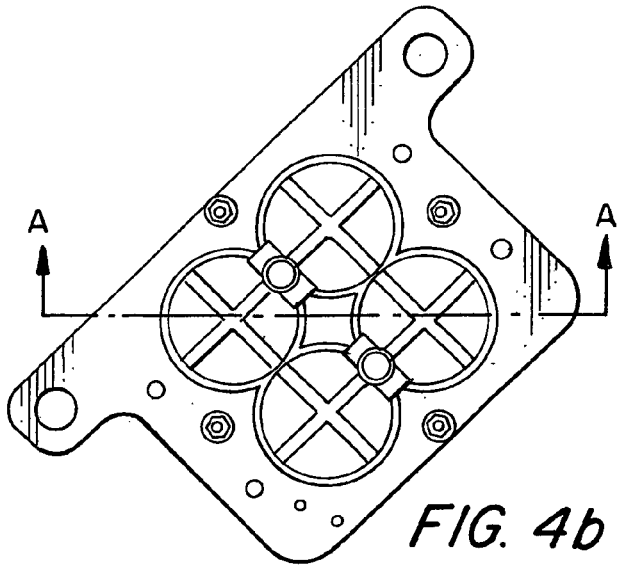
FIG. 4*b* is a top view thereof.
Figure 4C:
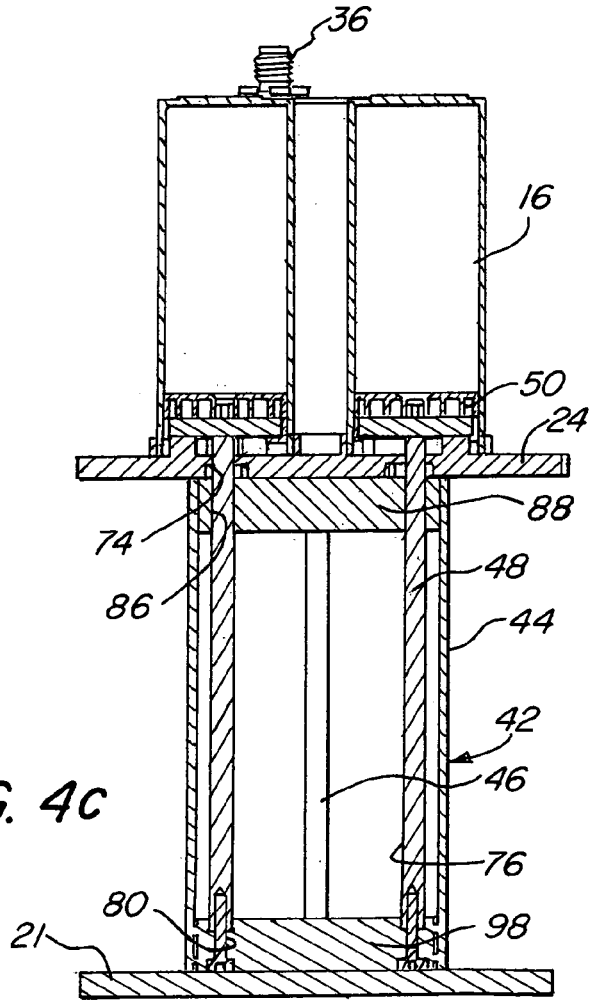
FIG. 4*c* is a sectional view along the line A—A of FIG. 4*b*.
Figure 5A:
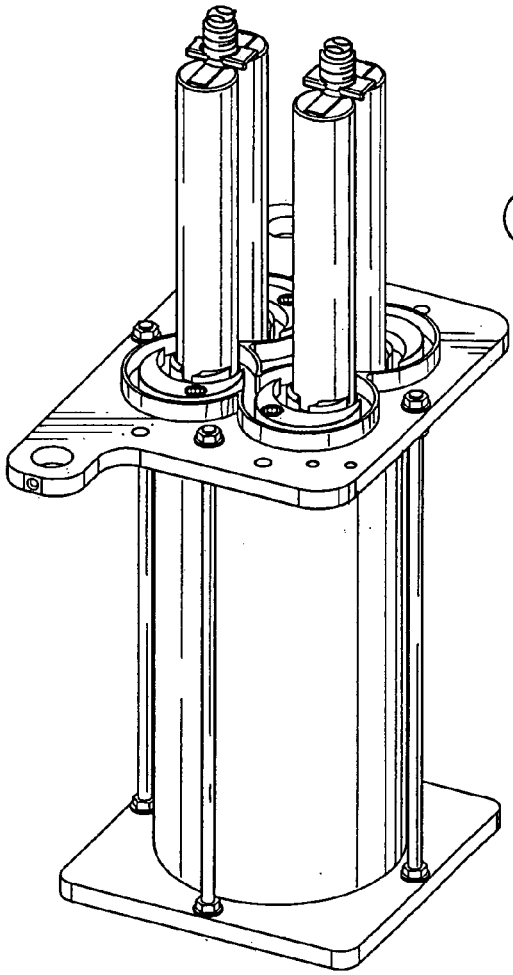
FIGS. 5*a*–5*c* are similar views of an assembly in which the four cartridges are of smaller diameter than those of FIGS. 4*a*–4*c*.
Figure 5B:
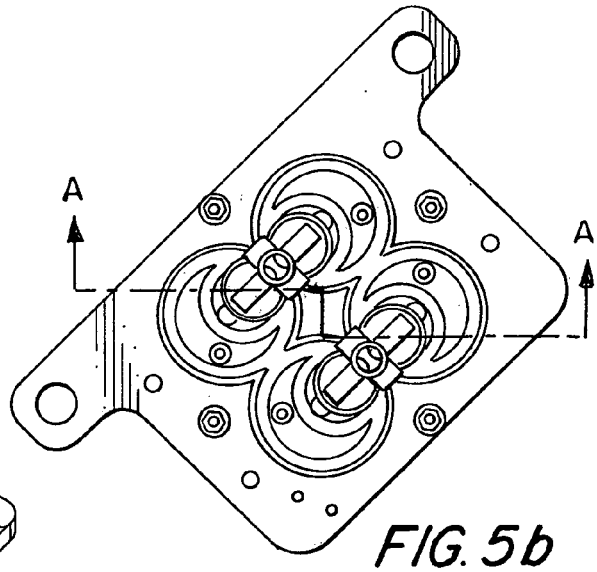
Figure 5C:
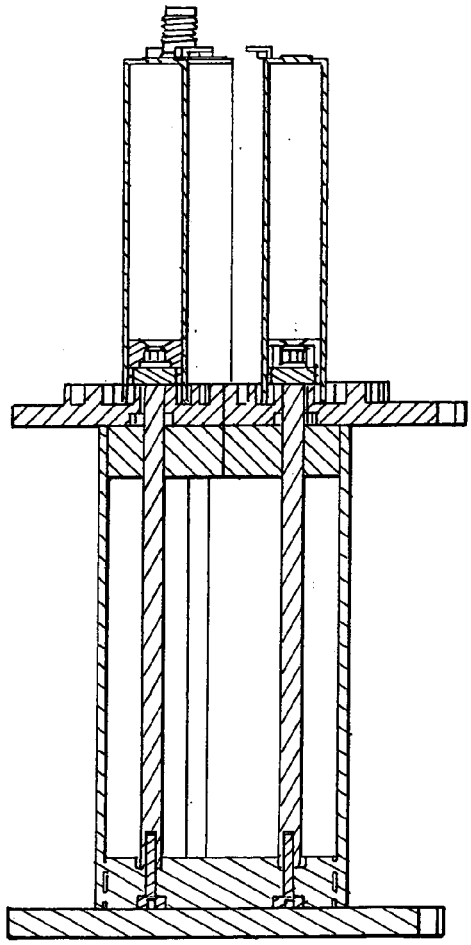
Figure 6A:
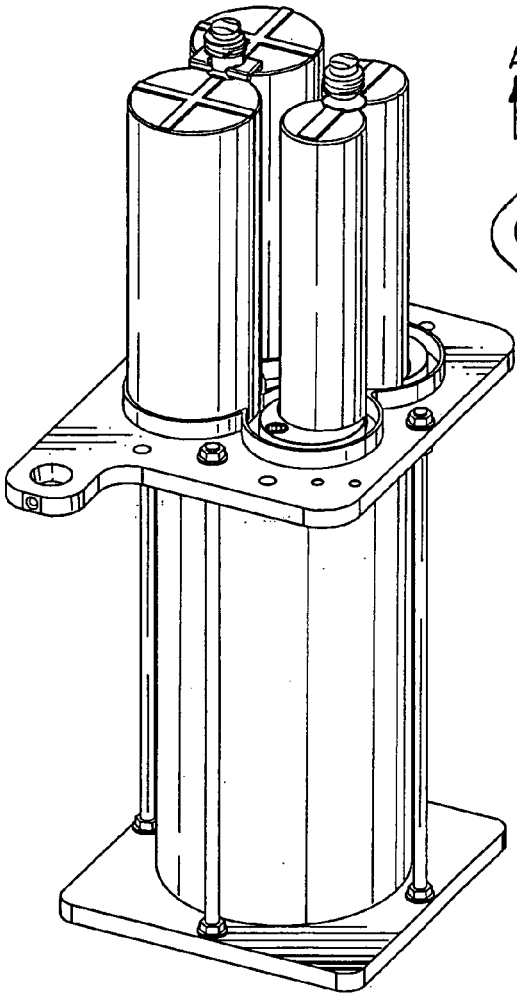
FIGS. 6*a*–6*c* are similar views of an assembly in which one pair of cartridges are of larger diameter than the other pair.
Figure 6B:
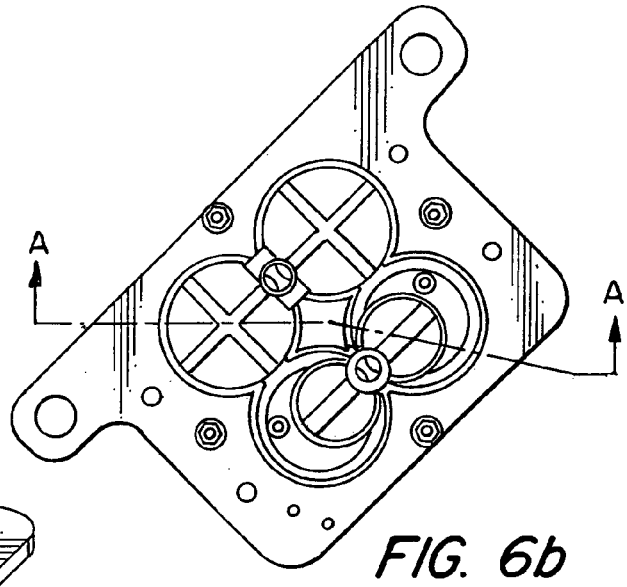
Figure 6C:
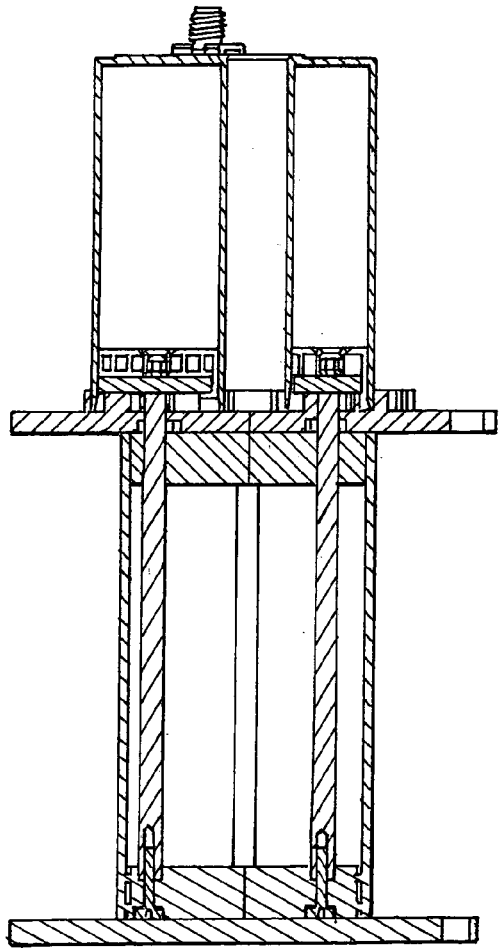
Figure 7B:
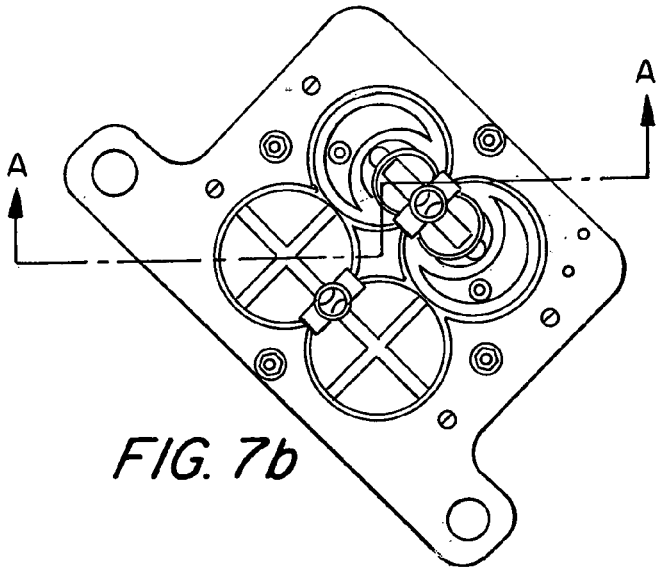
Figure 7A:
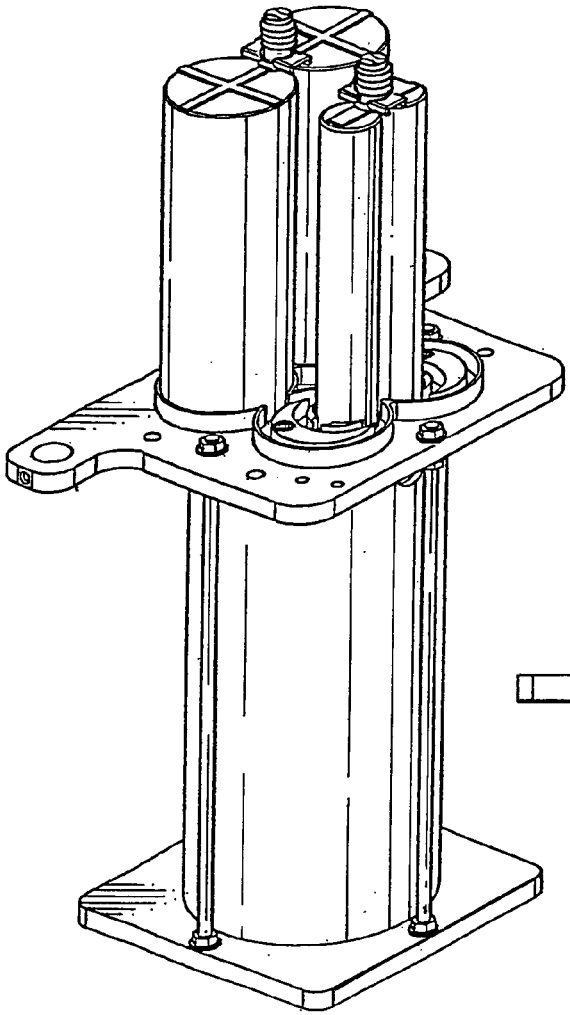
Figure 7B:
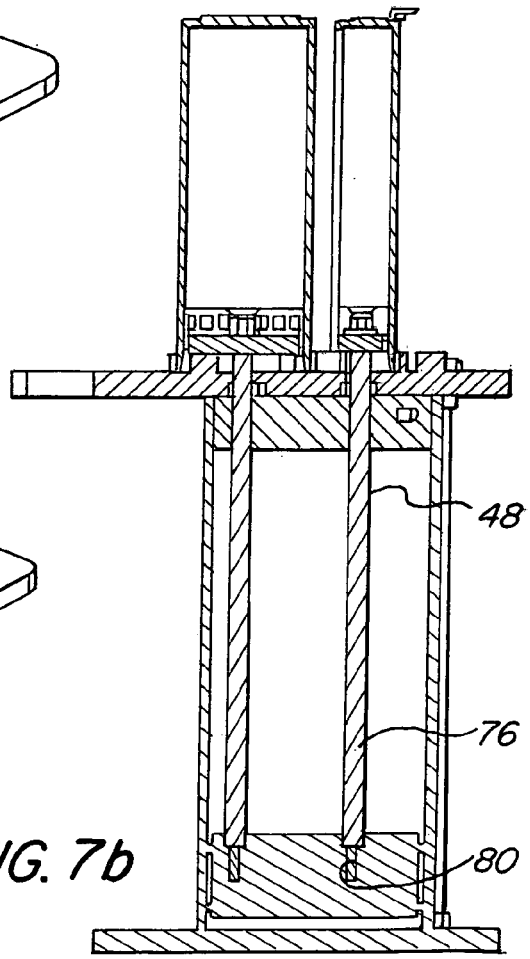

As seen in FIGS. 4*a*–4*c*, the cartridges 16 may be of the same diameter and volume and closely clustered with each pair having a common cannula. As seen in FIGS. 5*a*–5*c*, the cartridges 16 may be uniformly of lesser diameter requiring the push rods 48 to be moved into a position in which they will be coaxial with the cartridges 16. To accomplish the relocation of the push rods 48, they are threaded into the appropriate threaded holes (not shown) in the piston 46.

Figure 8A:
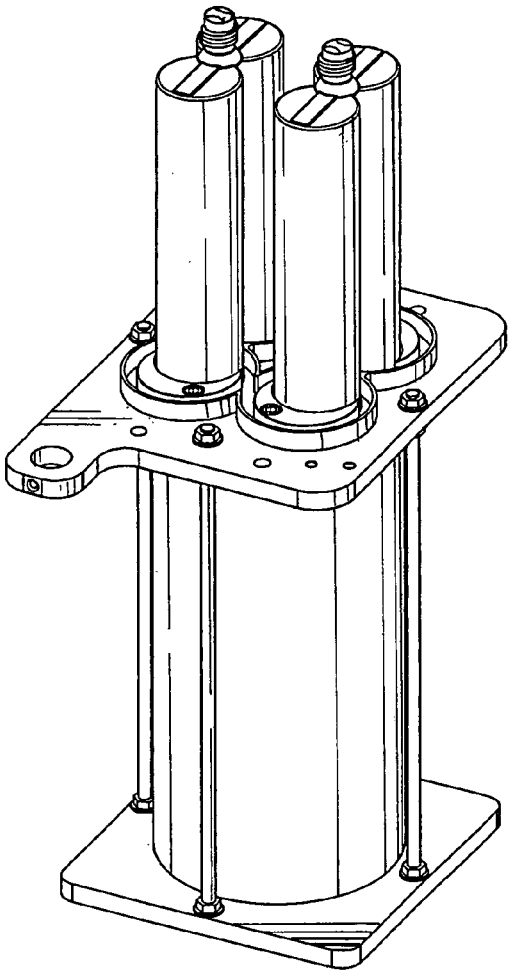
FIGS. 8*a*–8*c* are similar views of four equal, relatively small diameter cartridges.
Figure 8B:
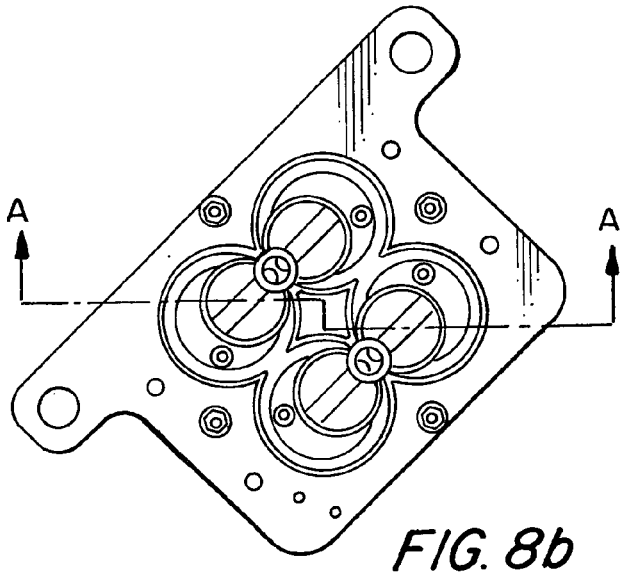
Figure 8C:
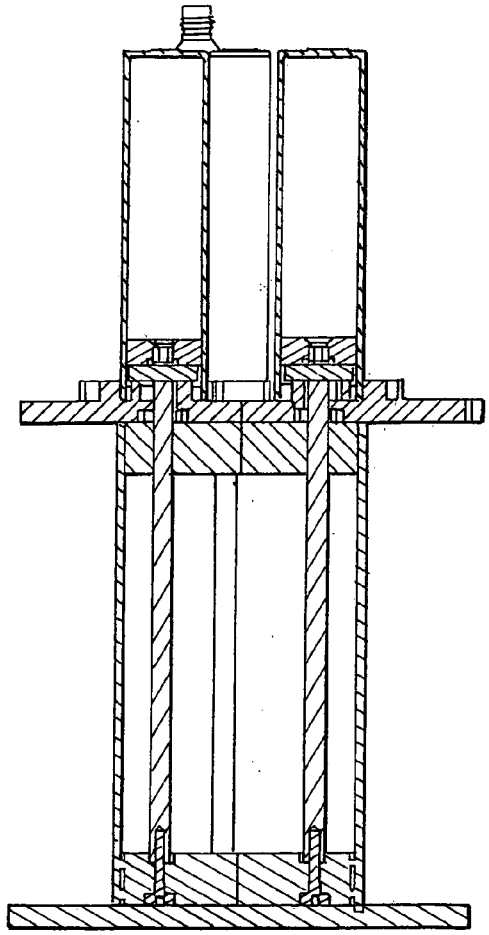

In FIGS. 6*a*–6*c* and FIGS. 7*a*–7*c* there is one pair of large diameter cartridges 16, and a smaller diameter pair to provide a 2.5:1 ratio and 5:1 ratio, respectively. In FIGS. 8*a*–8*c*, the four cartridges 16 are of uniform, but intermediate diameter.

In each of the illustrated assemblies of FIGS. 4–8, the cartridges of each pair abut each other and discharge into a common cannula.

As seen in FIGS. 10*a*–10*d*, the upper surface of the bottom support plate 24 has a cloverleaf contour of raised ribs 70 to position four cartridges which can be of four rings of the same diameter or two pairs of different diameters. The ribs 70 serve to position the lower end of the cartridges 16 of each pair so that they abut and thereby can discharge into a single cannula.

In addition, the support plate has a multiplicity of holes 74 through which the shafts or stems of the push rods 48 extend in coaxial alignment with the cartridges 16.

Figure 11A:
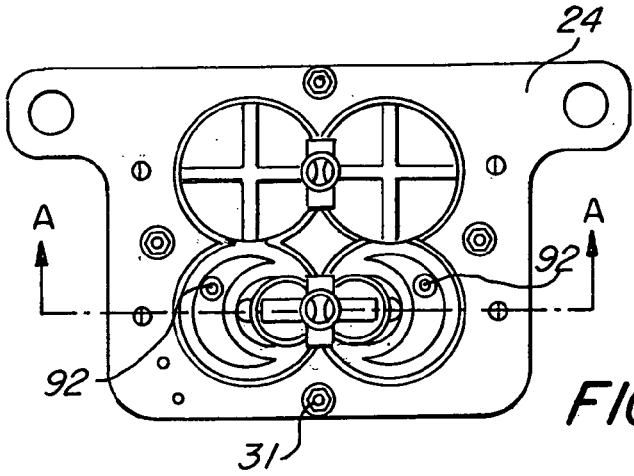
FIG. 11*a* is a top view of the bottom plate and cartridge.
Figure 11B:
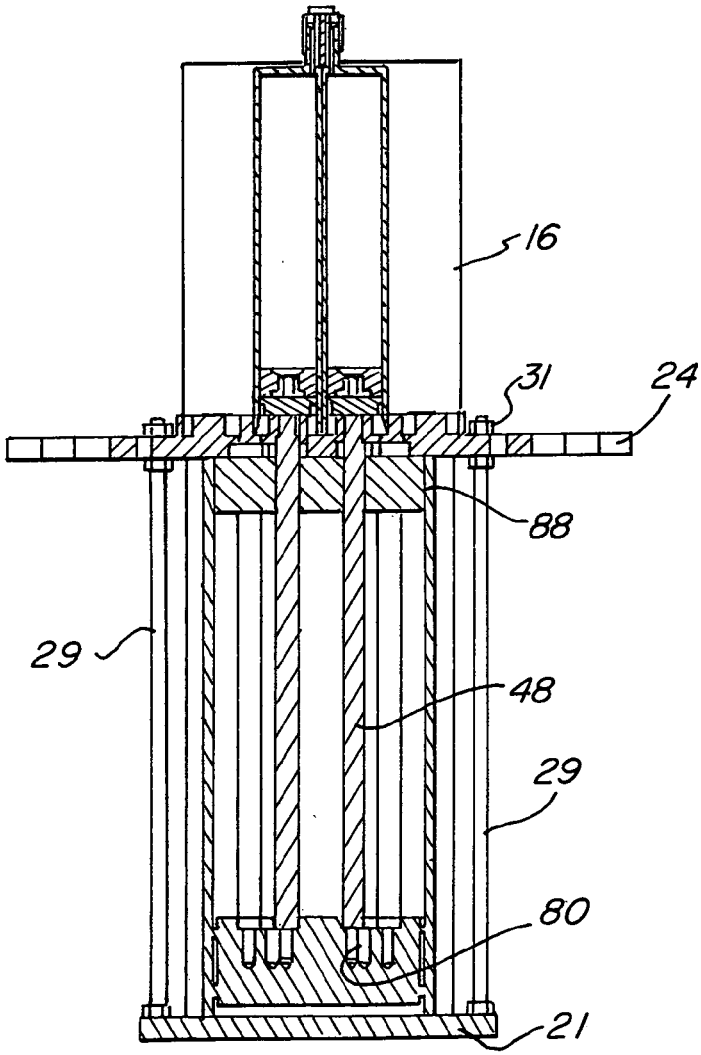
FIG. 11*b* is a sectional view along the line A—A of FIG. 11*a* showing the piston/cylinder, push rods, bottom support and cartridges.

To enable relocation of the push rods 48, and as seen in FIG. 11, the piston 46 is provided with threaded recesses 80 into which the lower ends of the shafts 76 on the push rods 48 can be threaded. The upper end plug 88 of the cylinder 44 is provided with holes 86 through which the shafts 76 of the push rods 48 extend, and the shafts 76 also extend through the holes 74 in the bottom support plate 24 seen in FIGS. 10*a*–10*d*.

To change the position of the push rods 48 for use with cartridges 16 of a different diameter, the knobs 25 are turned to release the top support plate 22 and the segments 30 are pivoted into an unblocking position. The spent cartridges are removed to expose the upper ends of the push rods 48 and the holes in the bottom support plate 24. The push rods 48 are unthreaded from the threaded piston recesses 80 and withdrawn.

The nuts 31 on the coupling rods 29 are removed and fasteners 92 securing the bottom support plate 24 to the cylinder top end plug 88 are removed. The bottom support plate 24 and cylinder end plug 88 are then removed from the cylinder 44.

A new end plug 88 and bottom support plate 24 having apertures 72 therethrough corresponding to the desired placement of the push rods 48 are now placed in and on the cylinder 44 and coupling rods 29 and the nuts 31 are tightened to secure the elements in assembly. The shafts 76 of the push rods 48 are inserted through the aligned holes 74 in the bottom support plate 24 and cylinder top end plug 88 and threaded into the apertures in the cylinder base plug 98. Seals (not shown) are provided around the push rods 46 in the holes in the top end plug 88.

As will be readily appreciated, the dispenser assembly described and illustrated affords significant advantages in that the contents of multiple cartridges can be simultaneously dispensed at a uniform rate. Changes in cartridge diameter or different ratios can be readily accommodated by moving the push rods as described hereinbefore. In the preferred system, at least one pair of cartridges are linked in a common cannula and, for most applications, the cartridges of each pair will be linked by a common cannula.

Although the dispenser of the present invention may only seat and dispense three cartridges simultaneously, units providing for dispensing four cartridges are most advantageously employed.

By providing the valves at the cannula, air can be exhausted from the cartridges before the contents are actually caused to flow into the discharge conduits to the handpiece. Moreover, when the rheology of the contents of one pair differs from the rheology of the contents of another pair, the discharge conduits can be changed in diameter or composition in an effort to balance the flow characteristics for the two components.

To minimize the waste which is generated from the use of the multiple cartridges, the contents for the individual cartridges are ideally provided in a collapsible bag which is supported within a cylindrical sleeve, and the push rods act upon shuttles to force the contents of the bag outwardly into the cannula. In this fashion, only the bags and the cannulae are disposed of. The conduits can be flushed out as can be the handpiece and the static mixer although the static mixer can also be disposable.

Controls for the supply of pressurized fluid to the cylinder are provided on the frame and are actuated by a valve on the handpiece. When pressurized gas is to be utilized in the dispensing of the contents from the handpiece, the preferred arrangement is one in which the gas supply conduit is coupled to the discharge conduits for the contents of the cartridges so that a single set of coupled conduits or hoses is manipulated by the operator. A trigger can be used as a "dead man" switch, or to operate the valve, or to control the supply of air to the contents passing therethrough.

The term "pressurized fluid" or "fluid" as used herein is meant to include not only air, carbon dioxide or other relatively inert gases, but also hydraulic fluid in a closed system when gas under pressure is being supplied to the handpiece for the particular application such as spraying or foaming the contents, air or an inert gas such as carbon dioxide is desirably employed.

The term "cartridge" as used herein is meant to include a conventional disposable cartridge and a sleeve in which a collapsible bag is supported.

In the illustrated embodiment, an inlet for pressurized air is shown on the frame and is connected to the cylinder and the handpiece. Pressurized air can be generated by a portable compressor. Alternatively, cylinders of pressurized gas can be utilized to provide the supply necessary to operate the elements of the dispenser.

As indicated previously, the handpiece can be adapted to connect to a source of dispersable materials such as fillers, fibers, abrasives and the like.

Where necessary, the time required between mixing of the contents of the cartridge and discharge from the applicator can be varied by placing the mixer prior to the handpiece at any point in the discharge conduits including immediately adjacent the cannulae. Moreover, the rate of motion of the piston within the cylinder can be varied.

Thus, the power dispenser of the present invention is readily adaptable to different ratios of components provided by cartridges and retention sleeves of different diameters. The dispenser is relatively east to fabricate at relatively low cost and is easy to maintain.

Having thus described the invention, what is claimed is:

1. A multi-cartridge powered dispenser comprising:

a) a frame including
   i) base and top cartridge supports and coupling elements extending therebetween;
   ii) wheels on the base of the frame for movement of the dispenser;
   iii) a handle for moving the dispenser;
   iv) a piston/cylinder supported on said frame b) at east three product containing cartridges each having a shuttle at one end and a discharge opening at the other end, said cartridges being clamped between said base and top supports, said piston having push rods coupled thereto and extending through said base support to move said shuttles in said cartridges;

c) a first pressurized fluid supply conduit connected to said piston/cylinder;

d) a valve in said fluid supply conduit;

e) at least one discharge cannula communicating with said outlet of at least one of said cartridges;

f) a handpiece for applying the contents of said cartridges to a work surface;

g) a first discharge conduit between said discharge cannula and said handpiece; and h) control means on said handpiece for opening and closing said valve in said fluid supply conduit to control the supply of fluid to said piston/cylinder and thereby the discharge of the contents of said cartridges and the flow of the contents to said handpiece.

2. The multi-cartridge powered dispenser in accordance with claim 1 wherein said dispenser includes releasable engagement means on said top support to clamp said cartridges when engaged and, upon release, to permit said top support to be moved to an unblocking position permitting insertion and removal of cartridges.

3. The multi-cartridge powered dispenser in accordance with claim 1 wherein there are four cartridges and four push rods.

4. The multi-cartridge powered dispenser in accordance with claim 1 wherein said cartridges are of equal diameter and volume.

5. The multi-cartridge powered dispenser in accordance with claim 1 wherein the cartridges of one pair are of lesser diameter and volume than other cartridges.

6. The multi-cartridge powered dispenser in accordance in accordance with claim 1 wherein there are a pair of cannulae each connecting with at least one cartridge and wherein there is a pair of discharge conduits extending from said cannulae to said handpiece.

7. The multi-cartridge powered dispenser in accordance in accordance with claim 1 wherein said push rods can be readily relocated to accommodate cartridges of different diameter.

8. The multi-cartridge powered dispenser in accordance with claim 1 wherein a static mixer is coupled to said handpiece and the contents of at least two cartridges are admixed in said static mixer.

9. The multi-cartridge powered dispenser in accordance with claim 1 wherein said handpiece is a sprayer.

10. The multi-cartridge powered dispenser in accordance in accordance with claim 1 wherein said handpiece is a roller applicator.

11. The multi-cartridge powered dispenser in accordance in accordance with claim 1 wherein there is connected to said handpiece a source of dispersible material pressure for dispersing said dispersible material into the output stream of said handpiece.

12. The multi-cartridge powered dispenser in accordance in accordance with claim 1 wherein there is included a conduit to said handpiece of a pressurized gas, said conduit being disposed to discharge the gas into the admixed components to enable variation in the density and/or structure of foamed resin being discharged from said handpiece.

13. The multi-cartridge powered dispenser in accordance in accordance with claim 1 wherein there is included a conduit to said handpiece of a pressurized gas, whereby the pressurized gas may be used to purge the handpiece and static mixer.

14. The multi-cartridge powered dispenser in accordance with claim 1 wherein there is included a gas supply conduit for gas under pressure connected to said handpiece to spray the contents being supplied thereto and a second valve for controlling the flow of gas therethrough.

15. The multi-cartridge powered dispenser in accordance with claim 1 wherein said upper support is pivotably mounted on said frame for movement to and from an unblocking position.

16. The multi-cartridge powered dispenser in accordance with claim 1 wherein said conduits from said cannulae to said handpiece are of different diameter to accommodate different flow characteristics of the product passing therethrough.

17. The multi-cartridge powered dispenser in accordance with claim 1 wherein there is a bleed valve between said discharge cannula and discharge conduit to bleed air from the cartridges.

18. The multi-cartridge powered dispenser in accordance with claim 1 wherein at least one of said cartridge supports includes multiple cartridge positioning formations for seating on one end of said cartridges.

19. The multi-cartridge powered dispenser in accordance with claim 18 wherein said at least one of said cartridge supports provides multiple pairs of cartridge positioning formations to receive and position cartridges of different diameters.

20. The multi-cartridge powered dispenser in accordance with claim 1 wherein said piston includes multiple cooperating elements for positioning of pairs of push rods in coaxial alignment with cartridges of different diameters.

21. The multi-cartridge powered dispenser in accordance with claim 1 wherein second and third cannulae are provided in communication with individual cartridges and second and third discharge conduits are provided between said second and third cannulae and said handpiece.

22. The multi-cartridge powered dispenser in accordance with claim 1 wherein a separate cannula is provided for each of said cartridges and separate discharge conduits extend therefrom to said handpiece.

23. The multi-cartridge powered dispenser in accordance with claim 1 wherein said cartridges include a collapsible bag in which the contents are disposed and a cylindrical sleeve in which the bag and shuttle are disposed.

* * * * *